US008851179B2

(12) United States Patent
DeFosse et al.

(10) Patent No.: US 8,851,179 B2
(45) **Date of Patent: *Oct. 7, 2014**

(54) PROCESS AND PROCESS LINE FOR THE PREPARATION OF HYDRAULIC FRACTURING FLUID

(71) Applicant: Encana Corporation, Calgary (CA)

(72) Inventors: Grant Todd DeFosse, Calgary (CA); Lois Louise McCorriston, Calgary (CA)

(73) Assignee: Encana Corporation, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/724,381

(22) Filed: Dec. 21, 2012

(65) Prior Publication Data

US 2013/0112419 A1 May 9, 2013

Related U.S. Application Data

(63) Continuation of application No. 12/626,845, filed on Nov. 27, 2009, now Pat. No. 8,360,152.

(51) Int. Cl.

| | |
|---|---|
| ***E21B 43/267*** | (2006.01) |
| ***E21B 19/00*** | (2006.01) |
| ***E21B 43/26*** | (2006.01) |
| ***B01F 3/12*** | (2006.01) |
| ***E21B 21/06*** | (2006.01) |

(52) U.S. Cl.

CPC ..... *E21B 43/26* (2013.01); *E21B 43/267* (2013.01); *E21B 19/00* (2013.01); *B01F 3/1271* (2013.01); *E21B 21/062* (2013.01); *B01F 3/1228* (2013.01); *B01F 3/1221* (2013.01)

USPC ..... 166/308.2; 166/90.1; 166/177.5; 166/308.5

(58) Field of Classification Search

None

See application file for complete search history.

(56) References Cited

U.S. PATENT DOCUMENTS

| | | | |
|---|---|---|---|
| 3,619,207 | A | 11/1971 | Dzurik et al. |
| 3,710,865 | A | 1/1973 | Kiel |

(Continued)

FOREIGN PATENT DOCUMENTS

| | | |
|---|---|---|
| CA | 2592717 | 12/2008 |
| CN | 2480546 | 3/2002 |
| CN | 2926498 | 7/2007 |

OTHER PUBLICATIONS

Levitt, David and Pope, Gary. Selection and Screening of Polymers for Enhanced-Oil Recovery. SPE 113845. Society of Petroleum Engineers, Improved Oil Recovery Symposium. 2008, p. 1-18.

(Continued)

*Primary Examiner* — Zakiya W Bates

(74) *Attorney, Agent, or Firm* — Bennett Jones LLP

(57) ABSTRACT

A process and process line is provided for preparing a friction-reduced hydraulic fracturing fluid at a central location which can be readily transported to an oil or gas well in a formation at a well site, comprising: preparing a mixture of polymer and water at the central location by shearing the polymer in the water in a high shear environment to create the friction-reduced hydraulic fracturing fluid; pumping the friction-reduced hydraulic fracturing fluid through a series of pumps and pipelines to the well site; and injecting the hydraulic fracturing fluid into the oil or gas well at a pressure sufficient to cause fracturing of the formation.

16 Claims, 3 Drawing Sheets

(56) References Cited

U.S. PATENT DOCUMENTS

| | | | |
|---|---|---|---|
| 3,727,689 | A | 4/1973 | Clampitt |
| 3,868,328 | A | 2/1975 | Boothe et al. |
| 3,938,594 | A | 2/1976 | Rhudy et al. |
| 4,137,182 | A | 1/1979 | Golinkin |
| 4,395,340 | A | 7/1983 | McLaughlin |
| 4,622,155 | A | 11/1986 | Harris et al. |
| 4,624,795 | A | 11/1986 | Dawson et al. |
| 4,716,932 | A | 1/1988 | Adams, Jr. |
| 5,002,125 | A | 3/1991 | Phillips et al. |
| 5,069,283 | A | 12/1991 | Mack |
| 5,303,998 | A | 4/1994 | Whitlatch et al. |
| 5,404,951 | A | 4/1995 | Lai et al. |
| 5,711,376 | A | 1/1998 | Sydansk |
| 6,039,999 | A | 3/2000 | Bakshi et al. |
| 6,776,235 | B1 | 8/2004 | England |
| 6,787,506 | B2 | 9/2004 | Blair et al. |
| 6,820,694 | B2 | 11/2004 | Willberg et al. |
| 8,360,152 | B2 * | 1/2013 | DeFosse et al. ..... 166/308.2 |
| 2009/0023614 | A1 | 1/2009 | Sullivan et al. |
| 2009/0281006 | A1 | 11/2009 | Walters et al. |

OTHER PUBLICATIONS

"Which do you want? Conventional fracs? Water fracs? Both!" Pinnacle Technologies Inc. http://www.pinntech.conn/pubs/CS/CS04_SP.pdf.

Mayerhofer, M., et al. Proppants? We Don't Need No Proppants. SPE 38611. Society of Petroleum Engineers, Annual Technical Conference and Exhibition. 1997, p. 457-64.

Palisch, T., et al. Slickwater Fracturing—Food for Thought. SPE 115766. Society of Petroleum Engineers, Annual Technical Conference and Exhibition. 2008, p. 1-20.

Evaluation of Impacts to Underground Sources of Drinking Water by Hydraulic Fracturing of Coalbed Methane Reservoirs. Chapter 4 Hydraulic Fracturing Fluids. United States Environmental Protection Agency. Jun. 2004, p. 4-1 to 4-26.

* cited by examiner

PROCESS AND PROCESS LINE FOR THE PREPARATION OF HYDRAULIC FRACTURING FLUID

This is a continuation of U.S. patent application Ser. No. 12/626,845 filed Nov. 27, 2009 which is currently pending.

FIELD OF THE INVENTION

The present invention relates generally to the field of hydraulic fracturing of oil and gas wells, and, more particularly, to a process and process line which allows for the formation of fracturing fluid at a central location.

BACKGROUND OF THE INVENTION

Hydraulic fracturing, or fracing, is used to initiate/stimulate oil or gas production in low-permeability reservoirs. Hydraulic fracing has become particularly valuable in gas reservoirs wells and has been a key factor in unlocking the potential of unconventional gas plays, such as coal-bed methane, tight gas and shale gas reservoirs.

In hydraulic fracing, a fluid is injected into a well at such high pressures that the structure "cracks", or fractures. Fracing is used both to open up fractures already present in the formation and to create new fractures. These fractures permit hydrocarbons and other fluids to flow more freely into or out of the well bore. Desirable properties of a hydraulic fracturing fluid may include high viscosity, low fluid loss, low friction during pumping into the well, stability under the conditions of use such as high temperature deep wells, and ease of removal from the fracture and well after the operation is completed.

Slick Water fracs have become more common, as they tend to be the least expensive of the fracture fluids. As part of the frac procedure, propping agents, or proppants, are often injected along with the fluid to "prop" open the new fractures and keep the cracks open when fracturing fluid is withdrawn. Hybrid fracs which are a combination of slick water and conventional frac technology are also becoming popular. A number of different proppants can be used such as sand grains, ceramics, sintered bauxite, glass or plastic beads, or other material. Thus, it is also important that the fracturing fluid be able to transport large amounts of proppant into the fracture.

Depending on the particular fracing operation, it may be necessary that the fluid be viscosified to help create the fracture in the reservoir and to carry the proppant into this fracture. In Hybrid fracs, crosslinkers could be added at the frac site, as the viscosity would be too high to pump through a pipeline. The high gel loading for non crosslinked Hybrid fracs would require that additional polymer be added at the frac site. Thus, water-based fracing fluids often include friction reducing polymers and/or viscosifiers such as polyacrylamides and polymethacrylamides, cross-linked polyacrylamides and cross-linked polymethacrylamides, polyacrylic acid and polymethacrylic acid, polyacrylates, polymers of N-substituted acrylamides, co-polymers of acrylamide with another ethylenically unsaturated monomer co-polymerizable therewith, 2-acrylamido-2-methylpropane sulfonic acid, polyvinyl pyrollidones, guar, substituted guars, other biopolymers such as xanthan such as xanthan gum, welan gum and diutan gum, derivatized biopolymers such as carboxymethyl cellulose, and other mixtures of polymers. Other chemicals such as scale inhibitor to prevent scaling, oxygen scavengers, $H_2S$ scavengers, biocides, and the like, may also be added.

It was common practice in the industry at one time to batch mix fracturing fluids at the well site. This was very costly and dependent upon water being present or being transported to remote sites and the bags of polymer, chemicals, etc. being transported on site. Further, incomplete mixing of the polymer and water was also a problem. If the dispersion of the polymer is incomplete, clumps of partially hydrated polymer can form, which clumps are commonly referred to in the industry as "fisheyes".

More recently, liquid polymers, such as DynaFrac™ HT fluids, are being brought to the well site. However, the price of the premixed polymer itself and the costs to transport these large totes of liquid polymer make this a very costly alternative.

The present invention addresses these problems and provides a more cost effective process for preparing hydraulic fracturing fluid.

SUMMARY OF THE INVENTION

In an aspect of the present invention, a process is provided for preparing a friction-reduced hydraulic fracturing fluid at a central location which can be readily transported to an oil or gas well in a formation at a well site, comprising:

- preparing a mixture of polymer and water at the central location by shearing the polymer in the mix water in a high shear environment to create the friction-reduced hydraulic fracturing fluid;
- pumping the friction-reduced hydraulic fracturing fluid through a series of pumps and pipelines to the well site; and
- injecting the hydraulic fracturing fluid into the gas well at a pressure sufficient to cause fracturing of the formation.

In one embodiment, additional water is added to the pumps to further dilute the friction-reduced hydraulic fracturing fluid.

In one embodiment, additives such as surfactants, acid, biocides, oxygen scavengers, $H_2S$ scavengers, scale inhibitors and the like are added to the water or the sheared friction-reduced hydraulic fracturing fluid prior to pumping it to the remote well site.

In another embodiment, the friction-reduced hydraulic fracturing fluid is retained in a surge tank at the remote well site prior to pumping it down the gas well. In another embodiment, a blender is provided at the well site for mixing proppant such as sand with the friction-reduced hydraulic fracturing fluid.

In another aspect of the present invention, a process line is provided, comprising:

- a water plant site having:
  - water supply;
  - a bulk polymer storage tank containing a supply of polymer;
  - a shearing mixer operably associated with both the bulk polymer storage tank and the water supply for receiving the polymer and mixing the polymer with sufficient water to form a friction-reduced hydraulic fracturing fluid;
- at least one pump for pumping the friction-reduced hydraulic fracturing fluid though at least one pipeline to a well site; and
- at least one fracturing pump located at the remote well site for receiving the hydraulic fluid/proppant mixture and pumping it down at least one gas well located at the well site.

In one embodiment, the process line further comprises a blender located at the remote site and operably associated with the at least one pipeline for receiving the friction-reduced hydraulic fracturing fluid and mixing it with a portion of a proppant.

In another embodiment, the process line comprises at least two pumps for pumping the friction-reduced hydraulic fracturing fluid through the at least one pipeline. In this embodiment, one could optionally provide a static mixer between the at least two pumps. The addition of the static mixer is to ensure thorough mixing of the polymer and water to prevent the formation of fisheyes. Studies have also shown that fisheyes and/or "microgels" present in some polymer gelled carrier fluids will plug pore throats, causing formation damage.

In another aspect of the present invention, a mobile hydraulic fracturing fluid preparation unit for preparing hydraulic fracturing fluid at a well site is provided, comprising:

- a mobile trailer having a plurality of wheels or a skid and further having:
  - a shearing mixer for receiving a polymer from a bulk polymer storage tank and for receiving water from a water source and operable to mix the polymer with sufficient water to hydrate the polymer, and
  - at least one pump for receiving the hydrated polymer and for receiving additional water from the water source to form the hydraulic fracturing fluid and for pumping the hydraulic fracturing fluid to at least one frac pump located at the well site, the at least one frac pump operable to deliver the hydraulic fracturing fluid to an oil or gas well located at the well site at a sufficient pressure to fracture the formation surrounding the well.

It is understood by those skilled in the art that a frac pump is a high-pressure, high-volume pump used in hydraulic fracturing treatments.

The shearing mixer can be any high-speed blender capable of rapidly dispersing (shearing) the polymer throughout the mix water.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF PREFERRED EMBODIMENT

Figure 1:
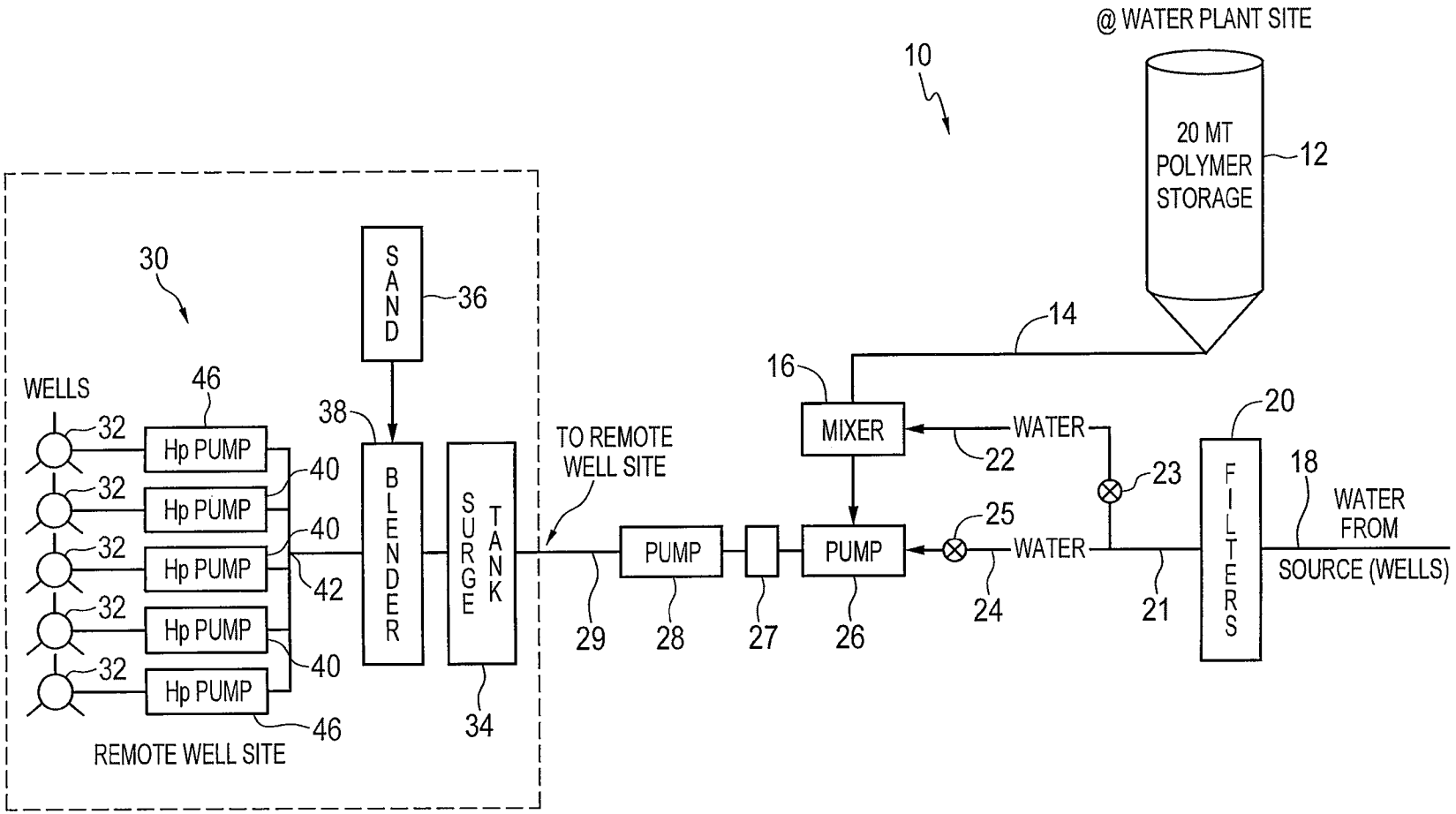
FIG. 1 is a schematic of a process line as per one embodiment of the present invention.

The detailed description set forth below in connection with the appended drawings is intended as a description of one of the embodiments of the present invention and is not intended to represent the only embodiments contemplated by the inventors. The detailed description includes specific details for the purpose of providing a comprehensive understanding of the present invention. However, it will be apparent to those skilled in the art that the present invention may be practiced without these specific details.

The present invention, both as to its organization and manner of operation, may best be understood by reference to the following description and the drawings wherein numbers are used throughout several views to label like parts. Certain parts which are mentioned may be absent in particular figures due to the view of the drawing or obstruction by other parts.

An embodiment of a process line of the present invention is illustrated in FIG. 1. The process line is generally divided into two main areas, water plant site 10 and remote well site 30. Turning first to water plant site 10, water is supplied to water plant site 10 from source wells 18 and optionally the water is filtered through a water filtering unit 20. It is understood, however, that in addition to freshwater or saline wells, any water source such as recycled water, a river, lake, ocean and the like can be used. Optionally, water filtering unit 20, for example, a commercial reverse osmosis water filter such as a filter manufactured by RainDance™ Water Systems LLC, can be used to reduce the total dissolved solids. In addition, reverse osmosis filters can also be designed for removal of sodium salts (desalination), bacteria, silica, sulfates, $H_2S$, etc. In the alternative, cyclone filters known in the art can be used. The water filtering unit 20 can act also act as a water storage tank itself or, in the alternative, a separate water storage tank can be provided (not shown). In one embodiment, the water storage tank is heated. Depending upon the quality of water from the water source delivers water, it may be possible to directly use the water without the need to filter or store the water.

A larger polymer storage tank 12 is also provided at the water plant site, which storage tank is preferably large enough to hold about 20 metric tonnes of polymer or more. Polymers useful in the present embodiment include friction reducing polymers such as partially hydrolyzed polyacrylamides, polyacrylamides and polymethacrylamides, cross-linked polyacrylamides and cross-linked polymethacrylamides, polyacrylic acid and polymethacrylic acid, polyacrylates, polymers of N-substituted acrylamides, co-polymers of acrylamide with another ethylenically unsaturated monomer copolymerizable therewith, 2-acrylamido-2-methylpropane sulfonic acid, polyvinyl pyrollidones, biopolymers such as xanthan, guars, derivitized guars, derivitized cellulose and other mixtures of polymers. Near the bottom of the polymer storage tank 12 is an auger or conveyer 14, which auger/conveyer 14 may be controlled by a control panel (not shown) at the water plant site 10.

The auger/conveyer 14 delivers an appropriate amount of polymer to high shear mixer 16. Water is also delivered to mixer 16 via pipe 22, which pipe 22 is connected to water filtering unit 20 via outlet pipe 21. The high shear mixer 16 can be any one of many high shear mixers known in the art which are capable of shearing a solid polymer with water. Useful high shear mixers generally comprise sharp blades or impellers, which blades or impellers are capable of rotating at very high speeds, for example, in excess of 40,000 rmp. An example of a high shear mixer useful in the present embodiment is an Urschel Laboratories Incorporated Comitrol® Processor Model 1700. It is understood, however, that other mixing vessels or mixing devices known in the art can also be used.

Figure 2:
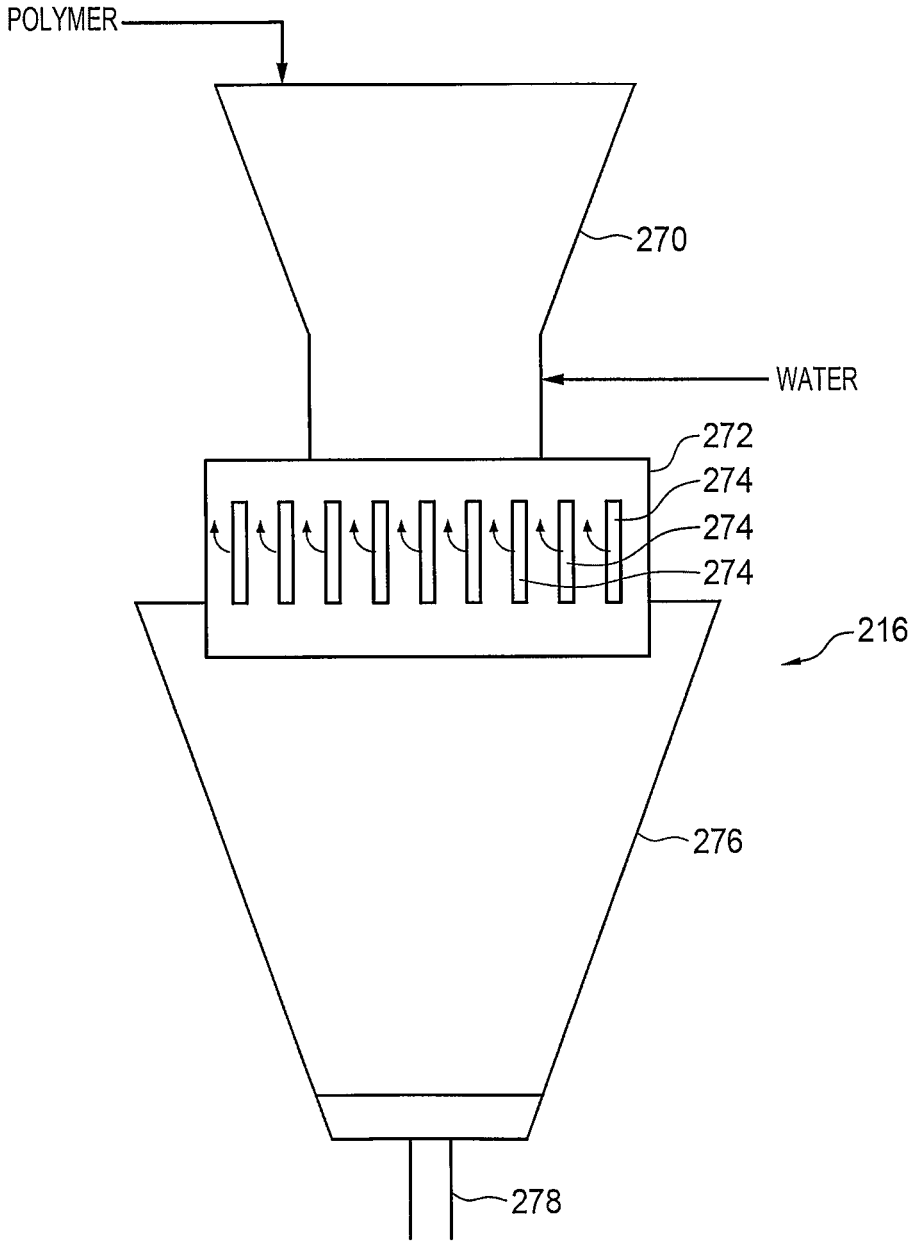
FIG. 2 is a schematic of a shearing mixer useful in the present invention.

An embodiment of a high shear mixer useful in the present invention is shown in more detail in FIG. 2. In this embodiment, high shear mixer 216 comprises hopper 270 for receiving polymer from the polymer storage tank. Water is added to hopper 270 for mixing with the polymer as well as for washing the impellers 274 contained in shear box 272. The sheared polymer/water mixture is then contained in holding vessel 276 prior to being removed from outlet 278 via a pump, such as pump 26 in FIG. 1.

Additional water may be added to the polymer/water mixture via pipe 24 while the polymer/water mixture is being pumped through pump 26 to form dilute hydraulic fracturing fluid having reduced friction. The ratio of polymer to water will be dependent upon the geophysical characteristics of a particular reservoir or formation. For example, in some instances, very little polymer will be added to the water, for example, when used for fracturing shale (low rate) wells. Sometimes, no polymer needs to be added at all. In this instance, valve 23 is shut off and instead only valve 25 is opened. In this instance, only pure water will be pumped to remote well site 30. Thus, in the present invention, the friction-reduced hydraulic fracturing fluid has a viscosity in the range of about 1 to about 15000 cP, more preferably about 1 to about 100 cp, and most preferably about 1 to about 20 cP. However, during a Hybrid frac some chemicals such as additional polymers and/or a cross linker are required to be added at the well site.

Additional chemicals can be added to the high shear mixture, for example, a scale inhibitor component to prevent scaling, oxygen scavengers, $H_2S$ scavengers, biocides, surfactants, caustic soda, antifoaming agents, iron chelators, and the like at pump 26. This can be added before or after the polymer. Once the polymer and water are sufficiently mixed, a "slippery" hydraulic fracturing fluid having reduced friction is formed. In one embodiment, an in-line static mixer is provided between pump 26 and another pump 28 to ensure that the polymer is completely hydrated. The reduced friction fracturing fluid can now be readily pumped through pipeline 29 to remote well site 30.

Remote well site 30 comprises a plurality of oil or gas wells 32 into which hydraulic fracturing fluid needs to be delivered. The hydraulic fracturing fluid can be stored for a period of time in surge tank 34 until fracturing operations begin. When fracturing operations begin, the fracturing fluid is optionally mixed with a proppant 36 such as sand grains, ceramics, sintered bauxite, glass or plastic beads, or other material, in a blender 38. The proppant blended hydraulic fracturing fluid can then be transported via piping 42 to a plurality of individual Hp pumps to the plurality of gas wells 32.

As previously mentioned, liquid polymer (hydraulic fracturing fluid) is normally transported directly to the remote well site. Thus, there are many expenses associated with transporting polymer and water to such remote sites. Further, addition of any other chemicals must also take place at the remote well site, hence, added to the costs are the costs associated with transporting these chemicals to these remote places. However, the embodiment of the invention as described above is much more cost effective, as the hydraulic fracturing fluid is made entirely at a central water plant site, which central site can then service a number of remote well sites simultaneously.

Figure 3:
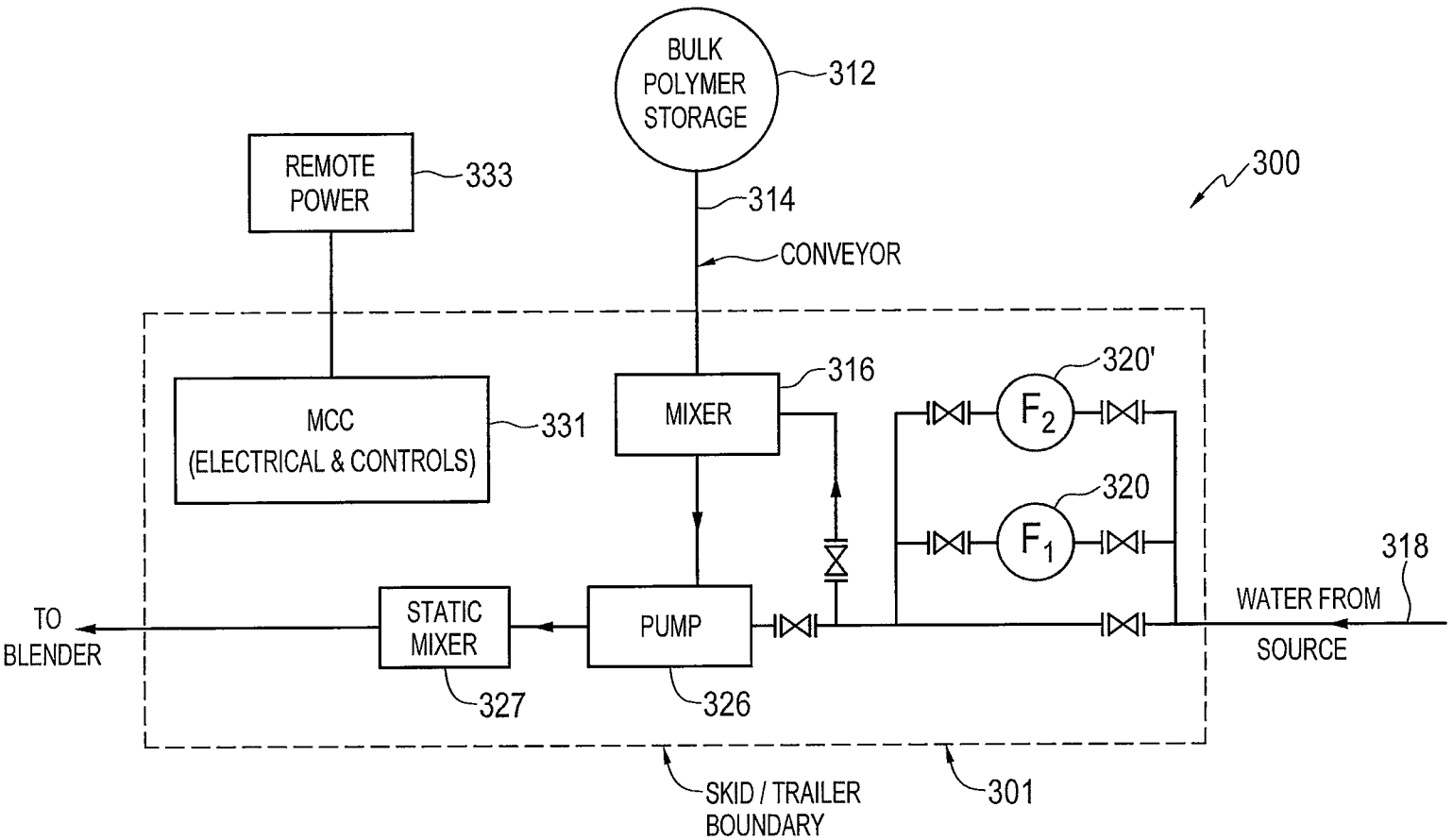
FIG. 3 is a schematic of an embodiment of a mobile hydraulic fracturing fluid preparation unit.

In another aspect of the present invention, an improved mobile hydraulic fracturing fluid unit is provided, which unit is designed to make hydraulic fracturing fluid directly at the well site without at least one of the previously discussed drawbacks, for example, the formation of fisheyes and the like. With reference now to FIG. 3, mobile hydraulic fracturing fluid unit 300 comprises a mobile trailer or skid 301 having a plurality of wheels or the like so that the unit can be easily transported to a remote well site. Already present at the remote well site is bulk polymer storage tank 312 and water source 318. Depending upon the water source, the water can be used either directly or treated prior to use.

In the embodiment shown in FIG. 3, unit 300 comprises a first water filter 320 and a second water filter 320'. Filtered or non-filtered water or both can then be delivered to shearing mixer 216 or pump 326 or both. To ensure complete mixing/hydration of the polymer with water, the polymer/water is pumped via pump 326 into in-line static mixer 327. It is understood that any static mixer known in the art can be used. Unit 300 also comprises motor control center (MCC) 331, which is designed to control some motors or all the motors of unit 300 from a central location, namely, remote power source 333, which power can be supplied by Hi Line (i.e., power right to the site off of the power line) or Gen Set (i.e., generator). Polymer is delivered to shearing mixer 316 from bulk polymer storage tank 312 via conveyer/auger 314. As shown in FIG. 1, once the hydraulic fracturing fluid is made, it can optionally be pumped to a blender where proppant can be added, if needed.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A process for preparing a friction-reduced hydraulic fracturing fluid at a central location which can be readily transported to an oil or gas well in a formation at a well site, comprising:

preparing a mixture of polymer and water at the central location by shearing the polymer in the water in a high shear environment to create the friction-reduced hydraulic fracturing fluid;

pumping the friction-reduced hydraulic fracturing fluid through a series of pumps and pipelines to the well site; and injecting the hydraulic fracturing fluid into the gas well at a pressure sufficient to cause fracturing of the formation.

2. The process as claimed in claim 1, further comprising adding additional water to the friction-reduced hydraulic fracturing fluid prior to pumping it to the well site.

3. The process as claimed in claim 1, further comprising adding an additive to the friction-reduced hydraulic fracturing fluid prior to pumping it to the remote well site.

4. The process as claimed in claim 3, wherein the additive is selected from the group consisting of surfactants, acids, biocides, $H_2S$ scavengers, scale inhibitors and $O_2$ scavengers.

5. The process as claimed in claim 1, wherein the polymer is selected from the group consisting of partially hydrolyzed polyacrylamides, polyacrylamides and polymethacrylamides, cross-linked polyacrylamides and cross-linked polymethacrylamides, polyacrylic acid and polymethacrylic acid, polyacrylates, polymers of N-substituted acrylamides, copolymers of acrylamide with another ethylenically unsaturated monomer co-polymerizable therewith, 2-acrylamido-2-methylpropane sulfonic acid, polyvinyl pyrollidones, guar, substituted guars, biopolymers such as xanthan gum, welan gum and diutan gum, carboxymethyl cellulose, and other mixtures of polymers.

6. The process as claimed in claim 1, further comprising:
retaining the friction-reduced hydraulic fracturing fluid in a surge tank located at the well site prior to pumping it down the well.

7. The process as claimed in claim 1, further comprising:
mixing the friction-reduced hydraulic fracturing fluid with a proppant in a blender located at the well site prior to pumping it down the well.

8. The proppant as claimed in claim 7, wherein the proppant is selected from the group consisting of sand grains, ceramics, sintered bauxite, glass beads and plastic beads.

9. A process line for preparing a friction-reduced hydraulic fracturing fluid at a central location for transport to an oil or gas well at a well site, comprising:
a water plant site having:
a water supply;
a bulk polymer storage tank containing a supply of polymer and a conveyer/auger at one end;
a shearing mixer operably associated with both the bulk polymer storage tank and the water supply for receiving the polymer and mixing the polymer with sufficient water to form a friction-reduced hydraulic fracturing fluid;
at least one pump for pumping the friction-reduced hydraulic fracturing fluid though at least one pipeline to the well site; and
at least one fracturing pump located at the remote well site for receiving the friction-reduced hydraulic fracturing fluid and pumping it down the oil or gas well located at the well site.

10. The process line as claimed in claim 9, further comprising at least two pumps for pumping the friction-reduced hydraulic fracturing fluid though the at least one pipeline to the well site.

11. The process line as claimed in claim 10, further comprising a static mixer between the at least two pumps.

12. The process line as claimed in claim 9, further comprising a surge tank located at the well site for retaining the friction-reduced hydraulic fracturing fluid prior to pumping it through the at least one fracturing pump.

13. The process line as claimed in claim 9, further comprising a blender located at the well site for receiving the friction-reduced hydraulic fracturing fluid and a proppant prior to pumping it through the at least one fracturing pump.

14. A mobile hydraulic fracturing fluid preparation unit for preparing hydraulic fracturing fluid for fracturing an oil or gas well formation at a well site, comprising:
a mobile trailer or skid having situated thereon:
a shearing mixer for receiving a polymer from a bulk polymer storage tank and for receiving water from a water source, said shearing mixer operable to mix the polymer with sufficient water to hydrate the polymer;
at least one pump for receiving the hydrated polymer and additional water from the water source to form the hydraulic fracturing fluid; and
a static mixer for receiving the hydraulic fracturing fluid to ensure complete hydration of the polymer prior to fracturing the formation.

15. The mobile unit as claimed in claim 14, further comprising at least one water filter for filtering the water prior to adding it to the polymer.

16. The mobile unit as claimed in claim 14, further comprising a motor control center for receiving power from a power source for controlling the equipment on the mobile unit.

* * * * *